US006412185B1

(12) United States Patent
Mills et al.

(10) Patent No.: US 6,412,185 B1
(45) Date of Patent: Jul. 2, 2002

(54) TILE LAYING GAUGE AND LEVELING ASSEMBLY

(76) Inventors: Oscar Mills; Mary Mills, both of 4851 Grovemont Pl., Orlando, FL (US) 32808

( * ) Notice: Subject to any disclaimer, the term of this patent is extended or adjusted under 35 U.S.C. 154(b) by 4 days.

(21) Appl. No.: 09/612,086

(22) Filed: Jul. 7, 2000

(51) Int. Cl.[7] ..... B28B 19/00; G01C 9/00

(52) U.S. Cl. ..... 33/526; 33/464; 33/518; 33/521; 52/749.11

(58) Field of Search ..... 33/526, 111, 354, 33/370, 374, 375, 376, 452, 464, 518, 521, 527, 533, 613, 645; 52/747.1, 747.11, 749.1, 749.11, DIG. 1

(56) References Cited

U.S. PATENT DOCUMENTS

| | | | | | |
|---|---|---|---|---|---|
| 2,770,043 | A | | 11/1956 | Kwiecinski | |
| 3,161,964 | A | * | 12/1964 | Myles | 33/370 |
| 4,067,117 | A | * | 1/1978 | Bernard | 33/375 |
| D285,780 | S | | 9/1986 | Wright et al. | |
| 4,712,309 | A | * | 12/1987 | Kingston et al. | 33/527 |
| 4,733,476 | A | * | 3/1988 | Schiffer | 33/518 |
| 5,038,490 | A | | 8/1991 | Armstrong | 33/527 |
| 5,181,326 | A | | 1/1993 | Eberline | 33/527 |
| 5,263,260 | A | * | 11/1993 | Smith | 33/526 |
| 5,701,680 | A | | 12/1997 | Garcia et al. | 33/526 |
| 5,768,793 | A | | 6/1998 | Fields | 33/526 |
| 5,807,022 | A | * | 9/1998 | McCleary | 52/749.11 |

* cited by examiner

*Primary Examiner*—Christopher W. Fulton

(57) ABSTRACT

A tile laying gauge and leveling assembly for preparing a recipient surface for the laying of tiles and for properly positioning the tiles on the recipient surface includes a plurality of elongated side members and a leveling assembly. Each of the side members has a first flange and a second flange whereby each side member has a generally L-shaped cross section. The leveling assembly has a substantially planar central panel and extension arms. The extension arms extend outward from opposite sides of the central panel and are designed to rest on the second flanges of the side members when the side members are positioned generally parallel with respect to each other. The central panel has a first longitudinal side that has a straight edge for determining if a plurality of tile has been properly positioned. In addition, the central panel has a second longitudinal side that has a plurality of notches designed for facilitating preparation of a recipient surface and for properly positioning tile.

16 Claims, 5 Drawing Sheets

TILE LAYING GAUGE AND LEVELING ASSEMBLY

BACKGROUND OF THE INVENTION

1. Field of the Invention

The present invention relates to devices that facilitate the laying of tile and more particularly pertains to a new tile laying gauge and leveling assembly for preparing a recipient surface for the laying of tiles and for properly positioning the tiles on the recipient surface.

2. Description of the Prior Art

The use of devices that facilitate the laying of tile is known in the prior art. More specifically, devices that facilitate the laying of tile heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,768,793; 5,181,326; 5,701,680; 5,038,490; 2,770,043; and U.S. Pat. No. Des. 285,780.

While these devices fulfill their respective, particular objectives and requirements, the aforementioned patents do not disclose a new tile laying gauge and leveling assembly. The inventive device includes a plurality of elongated side members and a leveling assembly that is designed to slide along the side members. The leveling assembly has a substantially planar central panel and extension arms. The extension arms extend outward from opposite sides of the central panel and are designed to rest on the side members when the side members are positioned generally parallel with respect to each other. The central panel has a first longitudinal side that has a straight edge for determining if a plurality of tile has been properly positioned. In addition, the central panel has a second longitudinal side that has a plurality of notches designed for facilitating preparation of a recipient surface and for properly positioning tile.

In these respects, the tile laying gauge and leveling assembly according to the present invention substantially departs from the conventional concepts and designs of the prior art, and in so doing provides an apparatus primarily developed for the purpose of preparing a recipient surface for the laying of tiles and for properly positioning the tiles on the recipient surface.

SUMMARY OF THE INVENTION

In view of the foregoing disadvantages inherent in the known types of devices that facilitate the laying of tile now present in the prior art, the present invention provides a new tile laying gauge and leveling assembly construction wherein the same can be utilized for preparing a recipient surface for the laying of tiles and for properly positioning the tiles on the recipient surface.

The general purpose of the present invention, which will be described subsequently in greater detail, is to provide a new tile laying gauge and leveling assembly apparatus and method which has many of the advantages of the devices that facilitate the laying of tile mentioned heretofore and many novel features that result in a new tile laying gauge and leveling assembly which is not anticipated, rendered obvious, suggested, or even implied by any of the prior art devices that facilitate the laying of tile, either alone or in any combination thereof.

To attain this, the present invention generally comprises a plurality of elongated side members and a leveling assembly.

Each of the side members has a first flange and a second flange whereby each side member has a generally L-shaped cross section. The leveling assembly has a substantially planar central panel and extension arms. The extension arms extend outward from opposite sides of the central panel and are designed to rest on the second flanges of the side members when the side members are positioned generally parallel with respect to each other. The central panel has a first longitudinal side that has a straight edge for determining if a plurality of tile has been properly positioned. In addition, the central panel has a second longitudinal side that has a plurality of notches designed for facilitating preparation of a recipient surface and for properly positioning tile.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new tile laying gauge and leveling assembly apparatus and method which has many of the advantages of the devices that facilitate the laying of tile mentioned heretofore and many novel features that result in a new tile laying gauge and leveling assembly which is not anticipated, rendered obvious, suggested, or even implied by any of the prior art devices that facilitate the laying of tile, either alone or in any combination thereof.

It is another object of the present invention to provide a new tile laying gauge and leveling assembly that may be easily and efficiently manufactured and marketed.

It is a further object of the present invention to provide a new tile laying gauge and leveling assembly that is of a durable and reliable construction.

An even further object of the present invention is to provide a new tile laying gauge and leveling assembly which is susceptible of a low cost of manufacture with regard to both materials and labor, and which accordingly is then susceptible of low prices of sale to the consuming public, thereby making such tile laying gauge and leveling assembly economically available to the buying public.

Still yet another object of the present invention is to provide a new tile laying gauge and leveling assembly which provides in the apparatuses and methods of the prior art some of the advantages thereof, while simultaneously overcoming some of the disadvantages normally associated therewith.

Still another object of the present invention is to provide a new tile laying gauge and leveling assembly for preparing a recipient surface for the laying of tiles and for properly positioning the tiles on the recipient surface.

Yet another object of the present invention is to provide a new tile laying gauge and leveling assembly that includes a plurality of elongated side members and a leveling assembly. Each of the side members has a first flange and a second flange whereby each side member has a generally L-shaped cross section. The leveling assembly has a substantially planar central panel and extension arms. The extension arms extend outward from opposite sides of the central panel and are designed to rest on the second flanges of the side members when the side members are positioned generally parallel with respect to each other. The central panel has a first longitudinal side that has a straight edge for determining if a plurality of tile has been properly positioned. In addition, the central panel has a second longitudinal side that has a plurality of notches designed for facilitating preparation of a recipient surface and for properly positioning tile.

Still yet another object of the present invention is to provide a new tile laying gauge and leveling assembly that can be easily taken apart of storage.

Even still another object of the present invention is to provide a new tile laying gauge and leveling assembly that is easy to use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
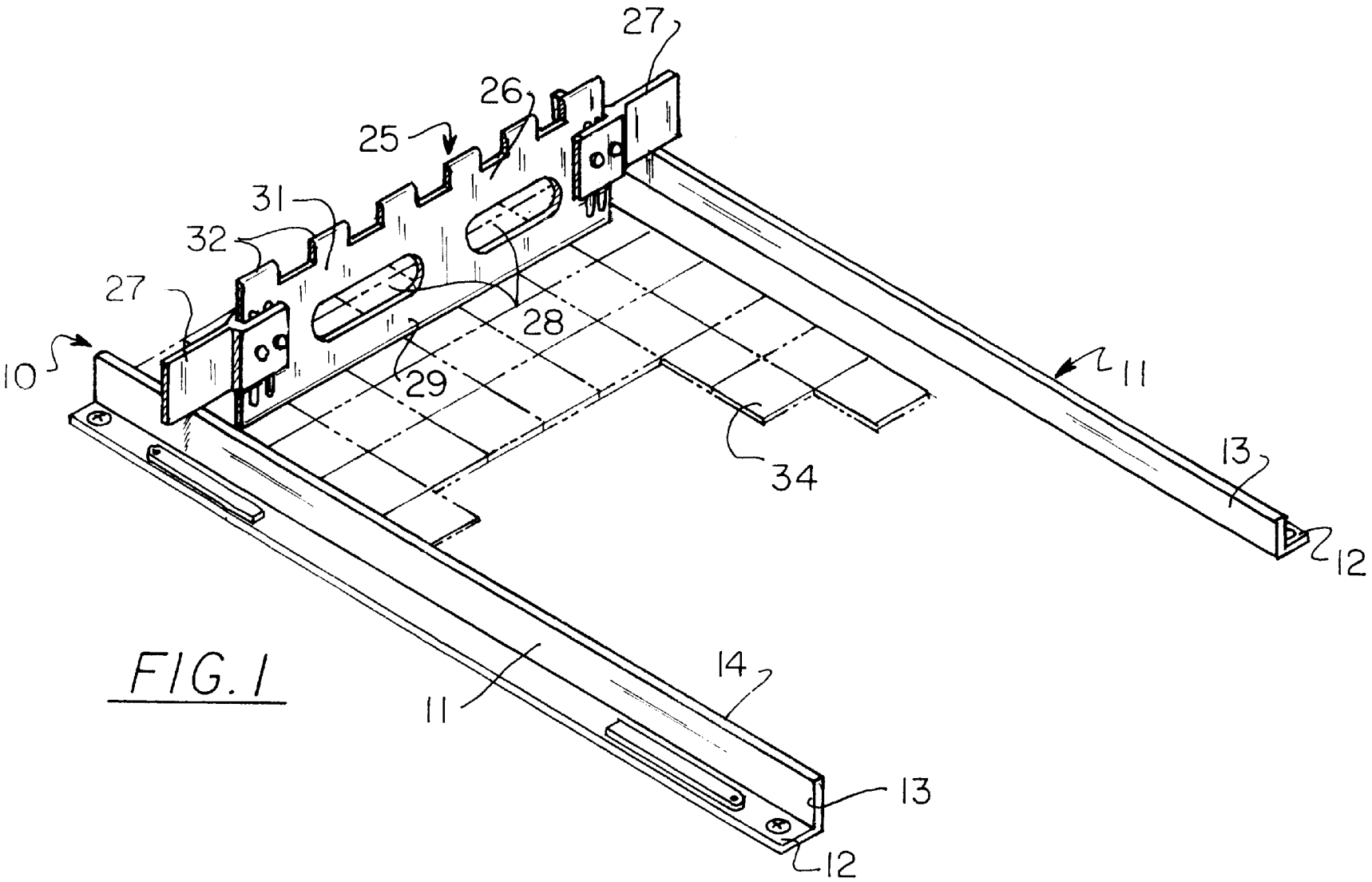
FIG. 1 is a schematic perspective view of a new tile laying gauge and leveling assembly according to the present invention.
Figure 2:
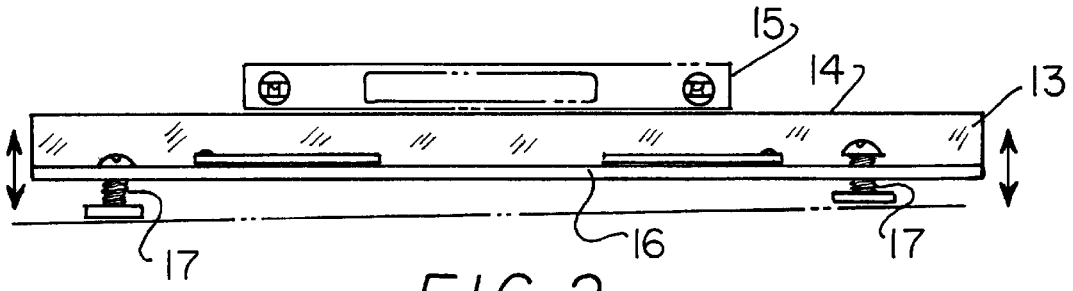
FIG. 2 is a schematic side view of a side member illustrating how a side member is leveled.
Figure 3:
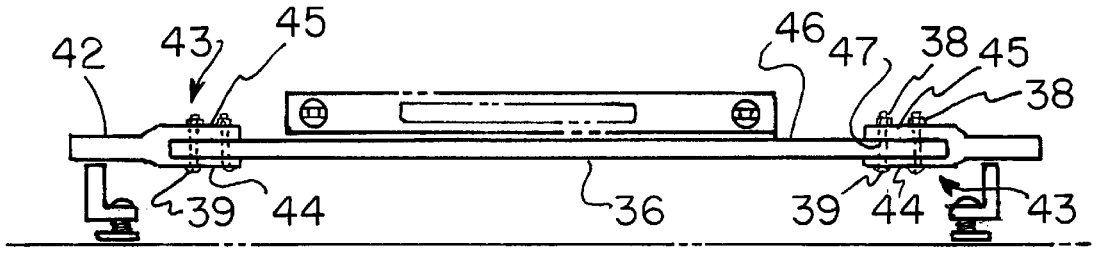
FIG. 3 is a schematic front view of the side members and central panel, illustrating how the side rails are leveled in relation to each other. This figure also illustrates the second embodiment of the extension arms.
Figure 4:
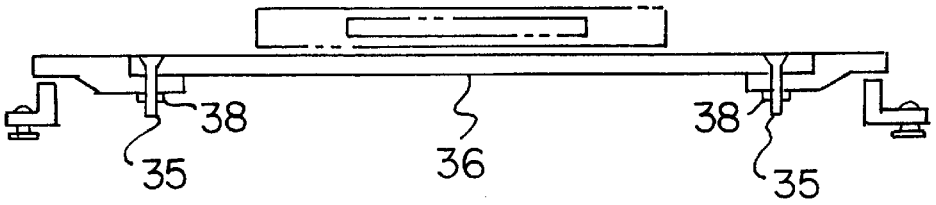
FIG. 4 is a schematic front view of the side members and central panel, illustrating how the side rails are leveled in relation to each other. This figure also illustrates the first embodiment of the extension arms.
Figure 5:
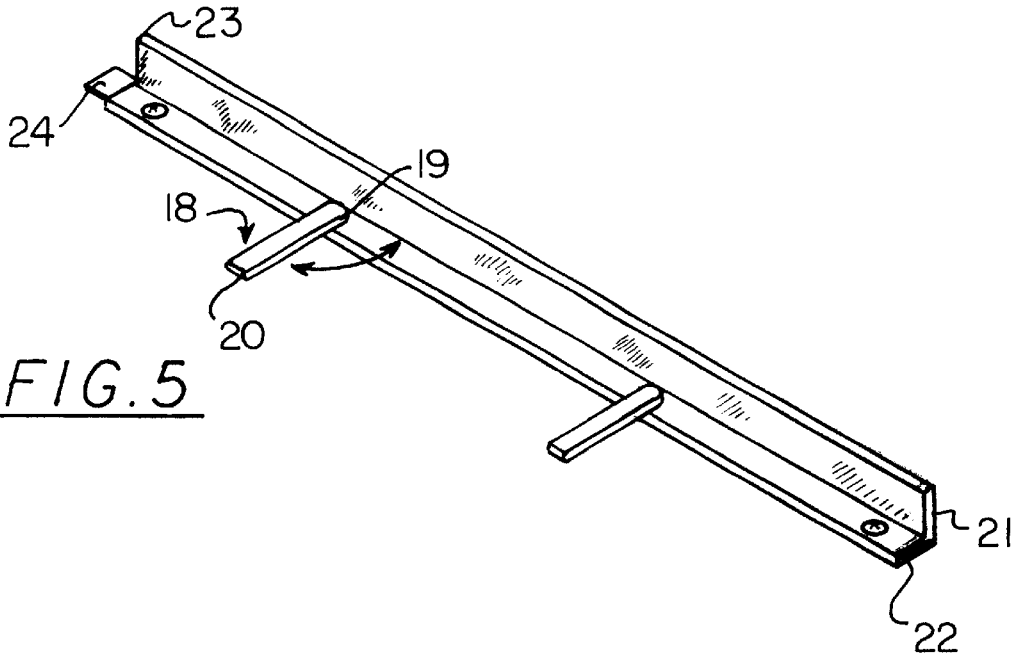
FIG. 5 is a schematic perspective view of a side member, illustrating the balance members.
Figure 6:
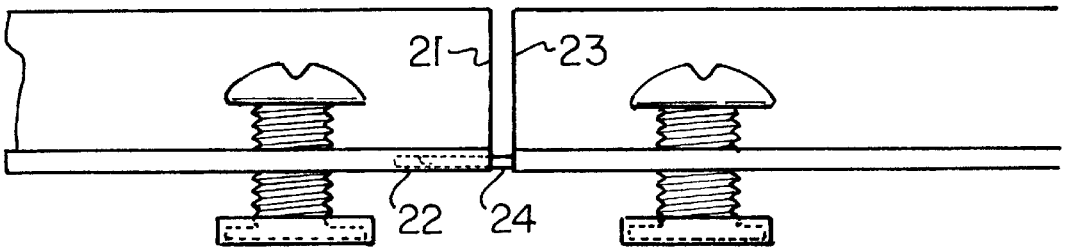
FIG. 6 is a schematic side view of the present invention, illustrating how a plurality of side members are connected together.
Figure 7:
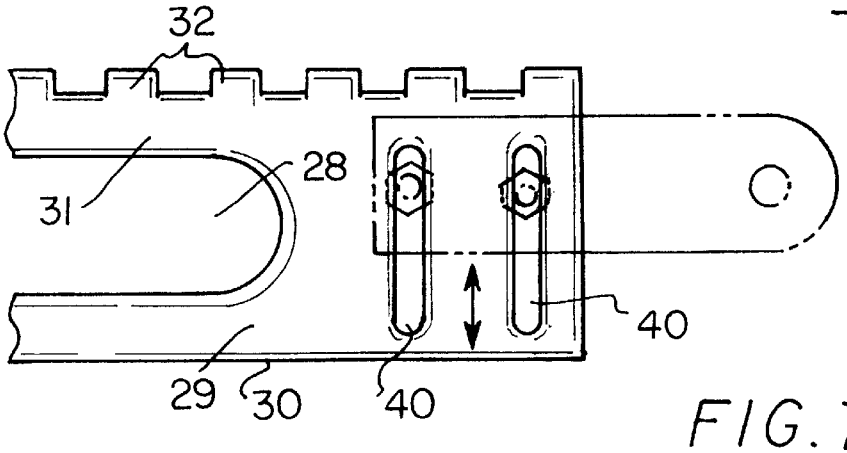
FIG. 7 is a schematic side view of the present invention, illustrating how the extension arm is connected to the central panel in the second embodiment.
Figure 8:
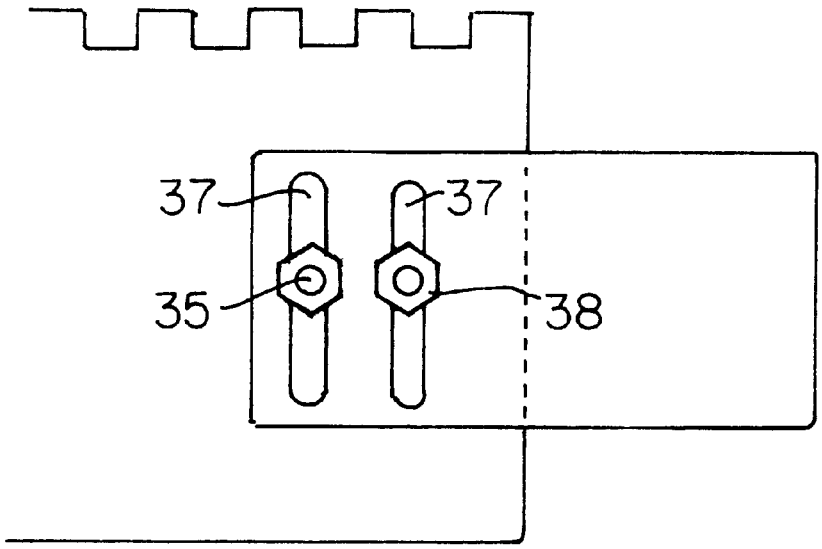
FIG. 8 is a schematic side view of the present invention, illustrating how the extension arm is connected to the central panel in the first embodiment.
Figure 9:
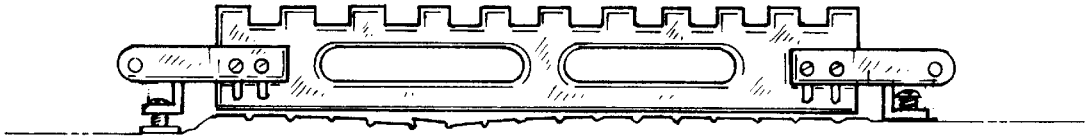
FIG. 9 is a schematic front view of the present invention, illustrating the first longitudinal side of the central panel in use.
Figure 10:
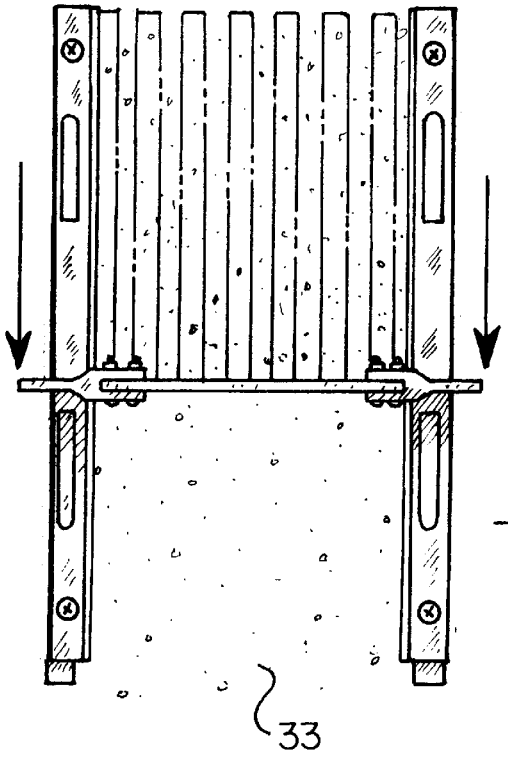
FIG. 10 is a schematic top view of the present invention, illustrating the second longitudinal side of the central panel in use.

With reference now to the drawings, and in particular to FIGS. 1 through 10 thereof, a new tile laying gauge and leveling assembly embodying the principles and concepts of the present invention and generally designated by the reference numeral 10 will be described.

As best illustrated in FIGS. 1 through 10, the tile laying gauge and leveling assembly 10 generally comprises a plurality of elongated side members 11. Each of the side members 11 has a generally L-shaped cross section with a first flange 12 and a second flange 13.

The second flange 13 has a distal edge 14 positioned parallel to a plane in which the first flange 12 lies. The first flange 12 is levelable by positioning a level 15 on the distal edge 13 of the second flange 12. In addition, the first flange 12 has a distal edge 16 positioned parallel to a plane in which the second flange 13 lies. The second flange is 13 levelable by positioning a level 15 on the distal edge 16 of the first flange 12.

Each side member 11 has a pair of leveling screws 17 that extend through the first flange 12. Each of the pair of leveling screws are positioned proximate an associated end of the first flange 12. Each side member 11 also has a pair of balance members 18. Each balance member 18 has a first end 19 pivotally coupled to the first flange 12 and a second end 20 that is positionable away from the second flange 13. The balance member 18 helps facilitate the balancing of a side member 11.

The length of the tile laying gauge and leveling assembly 10 may be adjusted by adding additional side members 11. Each of the side members 11 have a first end 21 that has a female connection portion 22 and a second end 23 that has a male connection portion 24. The male connection portion 24 is slidably insertable into the female connection portion 22 of an adjacently positioned side member 11 for facilitating alignment of a plurality of side members 11 in a row.

The tile laying gauge and leveling assembly 10 has a leveling assembly 25 that has a substantially planar central panel 26 and extension arms 27. The extension arms 27 extend outward from opposite sides of a central panel 26. Each of the extension arms 27 is positionable to rest on an edge of a respective one of the second flanges 13 of a side member 11 when the side members 11 are positioned generally parallel with respect to each other. When the leveling assembly 10 is properly positioned, the central panel 26 is positioned to extend between the side members 11.

The central panel 26 has a pair of finger slots 28 for facilitating manipulation of the central panel 26. The central panel 26 has a first longitudinal side 29 that has a straight edge 30 extending parallel to a longitudinal axis of the central panel 26. The central panel 26 has a second longitudinal side 31 that has a plurality of notches 32 adapted for facilitating preparation of a recipient surface 33 and for positioning tile 34.

Each extension arm 27 has a distal portion 42 and a connection portion 43. The connection portion 43 is offset from the distal portion 42 such that a face of the distal portion 42 is substantially coplanar with a face of the central panel 26 when the extension arm 27 is coupled to the central panel 26.

The central panel 26 has a plurality of threaded connection rods 35 that extend outward from a first face 36 of the central panel 26. Each extension arm 27 has a pair of connection slots 37. Each of the plurality of threaded connection rods 35 are insertable through an associated one of the connection slots 37. The connection rods are slidable within their associated connection slot 37 for adjustably coupling the extension arms 27 to the central panel 26. A plurality of connection members 38 engage the connection rods 35 for frictionally engaging the extension arms 27 to the central panel 26 such that each of the extension arms 27 is selectively holdable in a static position relative to the central panel 26.

In an embodiment, each extension arm 27 may have a connection portion 43 that has a first branch 44 and a second branch 45. The first branch 44 is selectively positioned adjacent the first face 36 of the central panel 26. The second branch 45 is selectively positioned adjacent to a second face 46 of the central panel 26.

In an embodiment, the central panel 26 has a plurality of slots 40. A plurality of apertures 47 that extend through the first branch 44 and through the second branch 45 of the extension arm 27 are alignable with the slots 40 in the central panel 26. The extension arms 27 are slidably coupled to the central panel 26 by a plurality of bolts 39. The bolts 39 are inserted through a plurality of slots 40 in the central panel 26 and through the associated plurality of apertures 41 that extend through the extension arms 27. A plurality of connection members 38 engage the bolts 35 for frictionally engaging the extension arms 27 to the central panel 26 such that each of the extension arms 27 are selectively holdable in a static position relative to the central panel 26.

In use a selected amount of side members 11 are coupled together to form a row and placed parallel to another row of side members. A level 15 is placed on the distal edge 14 of the second flange 13 of each side member 11 to determine if the side members are level. The leveling screws 17 may then be adjusted to level the longitudinal axis of the side members 11. The central panel 26 is then placed across the rows of side members 11 with its first face 36 facing the recipient surface 33. A level 15 may be placed on the second face 46 of the central panel 26 to determine if the rows of side members 11 are level in relation with each other. If the rows of side members 11 are not level with each other, the leveling screws 17 may be used to once again adjust the side members 11.

Once the tile laying gauge and leveling assembly 10 has been leveled, the central panel 26 is rotated so the second longitudinal side 31 is positioned adjacent to the concrete 33. The central panel 26 is then adjusted to the proper position by adjusting the extension arms 27. The central panel 26 is then moved along the rows of side members 11 whereby the notches in the second longitudinal side 31 prepare the concrete 33 and position the tile 34 for proper installation.

Once the tiles have been laid, the central panel 26 is rotated to so the first longitudinal side 30 is adjacent to the newly installed tiles 34. The extension arms 27 of the central panel 26 are then adjusted to properly position the central panel 26. The central panel 26 may then be slid down the rows of side members 11 thereby giving the user a visual guide in determining if each individual tile 34 is placed at the proper elevation.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and tiles 34. The extension arms 27 of the central panel 26 are then adjusted to properly position the central panel 26. The central panel 26 may then be slid down the rows of side members 11 thereby giving the user a visual guide in determining if each individual tile 34 is placed at the proper elevation. described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A tile laying gauge and leveling assembly comprising:

a plurality of elongated side members;

a leveling assembly having extension arms extending outwardly from opposite sides of a central panel, each of said extension arms being positionable to rest on an edge of a respective one of said side members when said side members are positioned generally parallel with respect to each other whereby said central panel is positioned to extend between said side members;

said central panel having a first longitudinal side having a straight edge extending parallel to a longitudinal axis of said central panel; and said central panel having a second longitudinal side having a plurality of notches adapted for facilitating preparation of a recipient surface for laying tile;

said central panel having a plurality of threaded connection rods extending outwardly from a first face of said central panel;

each of said extension arms having a pair of connection slots, each of said plurality of threaded connection rods being insertable through an associated one of said connection slots, each of said rods being slidable within said associated connection slot for adjustably coupling said extension arms to said central panel; and a plurality of connection members for engaging said connection rods for frictionally engaging said extension arms to said central panel such that each of said extension arms is selectively holdable in a static position relative to said central panel.

2. A tile laying gauge and leveling assembly of claim 1 further comprising:

each of said side members having a first flange and a second flange whereby each side member has a generally L-shaped cross section.

3. A tile laying gauge and leveling assembly of claim 2 further comprising:

said extension arms being positionable to rest on an edge of a respective one of side members of said second flanges.

4. A tile laying gauge and leveling assembly of claim 2 further comprising:

said second flange having a distal edge positioned parallel to a plane in which said first flange lies whereby said first flange is levelable by positioning a level on said distal edge of said second flange; and said first flange having a distal edge positioned parallel to a plane in which said second flange lies whereby said second flange is levelable by positioning a level on said distal edge of said first flange.

5. A tile laying gauge and leveling assembly of claim 1 further comprising:

each of said side members having a first end having a female connection portion and a second end having a male connection portion, said male connection portion being slidably insertable into said female connection portion of an adjacently positioned side member for facilitating alignment of a plurality said side members.

6. A tile laying gauge and leveling assembly of claim 1 further comprising:

said central panel having a pair of finger slots for facilitating manipulation of said central panel.

7. A tile laying gauge and leveling assembly of claim 1 further comprising:

each extension arm having a distal portion and a connection portion, said connection portion being offset from said distal portion such that a face of said distal portion is substantially coplanar with a face of said central panel when said extension arm is coupled to said central panel.

8. A tile laying gauge and leveling assembly comprising:

a plurality of elongated side members;

a leveling assembly having extension arms extending outwardly from opposite sides of a central panel, each of said extension arms being positionable to rest on an edge of a respective one of said side members when said side members are positioned generally parallel with respect to each other whereby said central panel is positioned to extend between said side members;

said central panel having a first longitudinal side having a straight edge extending parallel to a longitudinal axis of said central panel; and said central panel having a second longitudinal side having a plurality of notches adapted for facilitating preparation of a recipient surface for laying tile;

each of said side members having a first flange and a second flange whereby each side member has a generally L-shaped cross section;

each side member having a pair of leveling screws extending through said first flange, each of said pair of leveling screws being positioned proximate an associated end of said first flange.

9. A tile laying gauge and leveling assembly comprising:

a plurality of elongated side members;

a leveling assembly having extension arms extending outwardly from opposite sides of a central panel, each of said extension arms being positionable to rest on an edge of a respective one of said side members when said side members are positioned generally parallel with respect to each other whereby said central panel is positioned to extend between said side members, said central panel having a first longitudinal side having a straight edge extending parallel to a longitudinal axis of said central panel; and said central panel having a second longitudinal side having a plurality of notches adapted for facilitating preparation of a recipient surface for laying tile;

each of said side members having a first flange and a second flange whereby each side member has a generally L-shaped cross section;

each side member having a pair of balance members, each balance member having a first end pivotally coupled to said first flange such that a second end of said balance member is positionable away from said second flange for facilitating balanced positioning of said side member.

10. A tile laying gauge and leveling assembly comprising:

a plurality of elongated side members;

a leveling assembly having extension arms extending outwardly from opposite sides of a central panel, each of said extension arms being positionable to rest on an edge of a respective one of said side members when said side members are positioned generally parallel with respect to each other whereby said central panel is positioned to extend between said side members;

said central panel having a first longitudinal side having a straight edge extending parallel to a longitudinal axis of said central panel;

said central panel having a second longitudinal side having a plurality of notches adapted for facilitating preparation of a recipient surface for laying tile;

each of said extension arms having a connection portion, said connection portion having a first branch and a second branch, said first branch being selectively positioned adjacent a first face of said central panel, said second branch being selectively positioned adjacent to a second face of said central panel;

said central panel having a plurality of slots;

said first branch having a plurality of apertures extending through said first branch;

said second branch having a plurality of apertures extending through said second branch;

each of said apertures in said first branch and each of said apertures in said second branch being alignable with an associated said slot in said central panel;

a plurality of bolts being inserted through said plurality of slots in said central panel and being inserted through said associated plurality of apertures in said extension arms whereby said extension arms are slidably coupled to said central panel by said plurality of bolts; and a plurality of connection members engaging said bolts for frictionally engaging the extension arms to the central panel such that each of the extension arms are selectively holdable in a static position relative to the central panel.

11. A tile laying gauge and leveling assembly of claim 10 further comprising:

each of said side members having a first flange and a second flange whereby each side member has a generally L-shaped cross section.

12. A tile laying gauge and leveling assembly of claim 11 further comprising:

said extension arms being positionable to rest on an edge of a respective one of said side members of said second flanges.

13. A tile laying gauge and leveling assembly of claim 11 further comprising:

said second flange having a distal edge positioned parallel to a plane in which said first flange lies whereby said first flange is levelable by positioning a level on said distal edge of said second flange; and said first flange having a distal edge positioned parallel to a plane in which said second flange lies whereby said second flange is levelable by positioning a level on said distal edge of said first flange.

14. A tile laying gauge and leveling assembly of claim 10 further comprising:

each of said side members having a first end having a female connection portion and a second end having a male connection portion, said male connection portion being slidably insertable into said female connection portion of an adjacently positioned side member for facilitating alignment of a plurality said side members.

15. A tile laying gauge and leveling assembly of claim 10 further comprising:

said central panel having a pair of finger slots for facilitating manipulation of said central panel.

16. A tile laying gauge and leveling assembly comprising:

a plurality of elongated side members, each of said side members having a first flange and a second flange whereby each side member has a generally L-shaped cross section;

said second flange having a distal edge positioned parallel to a plane in which said first flange lies whereby said first flange is levelable by positioning a level on said distal edge of said second flange;

said first flange having a distal edge positioned parallel to a plane in which said second flange lies whereby said second flange is levelable by positioning a level on said distal edge of said first flange;

each side member having a pair of leveling screws extending through said first flange, each of said pair of leveling screws being positioned proximate an associated end of said first flange;

each side member having a pair of balance members, each balance member having a first end pivotally coupled to said first flange such that a second end of said balance member is positionable away from said second flange for facilitating balanced positioning of said side member;

each of said side members having a first end having a female connection portion and a second end having a male connection portion, said male connection portion being slidably insertable into said female connection portion of an adjacently positioned side member for facilitating alignment of a plurality said side members;

a leveling assembly having extension arms extending outwardly from opposite side of a substantially planar central panel, each of said extension arms being positionable to rest on an edge of a respective one of said second flanges when said side members are positioned generally parallel with respect to each other whereby said central panel is positioned to extend between said side members;

said central panel having a pair of finger slots for facilitating manipulation of said central panel;

said central panel having a first longitudinal side having a straight edge extending parallel to a longitudinal axis of said central panel;

said central panel having a second longitudinal side having a plurality of notches adapted for facilitating preparation of a recipient surface for laying tile;

said central panel having a plurality of threaded connection rods extending outwardly from a first face of said central panel;

each of said extension arms having a pair of connection slots, each of said plurality of threaded connection rods being insertable through an associated one of said connection slots, each of said rods being slidable within said associated connection slot for adjustably coupling said extension arms to said central panel;

a plurality of connection members for engaging said connection rods for frictionally engaging said extension arms to said central panel such that each of said extension arms is selectively holdable in a static position relative to said central panel; and each extension arm having a distal portion and a connection portion, said connection portion being offset from said distal portion such that a face of said distal portion is substantially coplanar with a face of said central panel when said extension arm is coupled to said central panel.

* * * * *